US009284086B2

(12) United States Patent
Humele et al.

(10) Patent No.: US 9,284,086 B2
(45) Date of Patent: Mar. 15, 2016

(54) GLUING UNIT

(71) Applicant: KRONES AG, Neutraubling (DE)

(72) Inventors: Heinz Humele, Thalmassing (DE); Christian Stoiber, Michelsneukirchen (DE); Christian Holzer, Schierling (DE); Ludwig Ferstl, Obertraubling (DE)

(73) Assignee: KRONES AG, Neutraubling (DE)

( * ) Notice: Subject to any disclaimer, the term of this patent is extended or adjusted under 35 U.S.C. 154(b) by 174 days.

(21) Appl. No.: 14/056,206

(22) Filed: Oct. 17, 2013

(65) Prior Publication Data

US 2014/0116332 A1 May 1, 2014

(30) Foreign Application Priority Data

Oct. 25, 2012 (DE) ..... 10 2012 219 554

(51) Int. Cl.

| | |
|---|---|
| ***B05C 1/00*** | (2006.01) |
| ***B65C 9/22*** | (2006.01) |
| ***B05C 1/08*** | (2006.01) |
| ***B05C 1/12*** | (2006.01) |
| *B65C 9/00* | (2006.01) |

(52) U.S. Cl.

CPC ..... *B65C 9/2256* (2013.01); *B05C 1/0821* (2013.01); *B05C 1/12* (2013.01); *B65C 9/2247* (2013.01); *B65C 2009/0075* (2013.01); *Y10S 118/14* (2013.01); *Y10S 118/15* (2013.01)

(58) Field of Classification Search

CPC ..... B05C 1/12; B05C 1/0821; B65C 9/2247; B65C 9/2256; B65C 2009/0075; B65C 2009/0071; B65C 9/30; Y10S 118/14; Y10S 118/15

USPC ..... 156/575, 578; 29/895; 118/100–271, 118/304, DIG. 3, DIG. 14, DIG. 15

See application file for complete search history.

(56) References Cited

U.S. PATENT DOCUMENTS

| | | | | |
|---|---|---|---|---|
| 4,293,989 | A | 10/1981 | Schneider | |
| 4,683,835 | A | 8/1987 | Kronseder | |
| 4,772,354 | A * | 9/1988 | Olsen et al. | 156/578 |
| 5,961,721 | A | 10/1999 | Feldkamper et al. | |
| 5,967,035 | A | 10/1999 | Kustermann | |
| 6,202,557 | B1 | 3/2001 | Kustermann | |

(Continued)

FOREIGN PATENT DOCUMENTS

| | | | |
|---|---|---|---|
| DE | 603440 | A | 9/1934 |
| DE | 620754 | C | 10/1935 |

(Continued)

OTHER PUBLICATIONS

Search Report for EP 13 18 7660, dated Mar. 21, 2014.

(Continued)

*Primary Examiner* — Laura Edwards

(74) *Attorney, Agent, or Firm* — Marshall, Gerstein & Borun LLP

(57) ABSTRACT

The invention comprises a gluing unit, in particular for a labeling apparatus, comprising a glue roller (1) and a motor (2) for driving the glue roller (1), where the motor (2) is positioned above the glue roller (1), where the motor (2) is with respect to a support structure (3) of the motor mounted in a height-adjustable manner, and where the height of the motor (2) is adjustable using a lever, in particular using an elbow lever (23) or a rocker lever.

20 Claims, 13 Drawing Sheets

(56) References Cited

U.S. PATENT DOCUMENTS

| | | | | |
|---|---|---|---|---|
| 7,597,759 | B1 * | 10/2009 | Delmoro et al. | 118/214 |
| 2001/0032585 | A1 | 10/2001 | Koehn et al. | |
| 2002/0129764 | A1 | 9/2002 | Jacobson et al. | |
| 2011/0162804 | A1 * | 7/2011 | Secchi et al. | 156/356 |

FOREIGN PATENT DOCUMENTS

| | | | |
|---|---|---|---|
| DE | 2500174 | A1 | 7/1976 |
| DE | 2945890 | A1 | 5/1981 |
| DE | 2825561 | C2 | 5/1983 |
| DE | 3515675 | C2 | 5/1989 |
| DE | 9403367 | U1 | 9/1994 |
| DE | 4412750 | A1 | 10/1994 |
| DE | 29701547 | U1 | 3/1997 |
| DE | 19634594 | C2 | 10/1998 |
| DE | 19714645 | A1 | 10/1998 |
| DE | 10255484 | A1 | 6/2004 |
| DE | 102008005661 | B4 | 2/2010 |
| DE | 102008038147 | A1 | 2/2010 |
| DE | 102008041268 | A1 | 2/2010 |
| DE | 102011082283 | A1 | 3/2013 |
| EP | 1129953 | A1 | 9/2001 |
| EP | 1147822 | A2 | 10/2001 |
| EP | 2080563 | A2 | 7/2009 |
| EP | 2567903 | A1 | 3/2013 |
| EP | 2610188 | A1 | 7/2013 |
| WO | WO-9523093 | A1 | 8/1995 |
| WO | WO-2010009778 | A1 | 1/2010 |

OTHER PUBLICATIONS

Search report for DE 10 2012 219 554.8, dated Apr. 9, 2013.
Search report DE 10 2012 219 552.1, dated May 6, 2013.
German Search Report for Application No. 10 2012 219 552.1, dated May 6, 2013.
German Search Report for Application No. 10 2012 219 554.8, dated Apr. 9, 2013.

* cited by examiner

GLUING UNIT

CROSS-REFERENCE TO RELATED APPLICATION

The present application claims the benefit of priority of German Application No. 10 2012 219 554.8, filed Oct. 25, 2012. The entire text of the priority application is incorporated herein by reference in its entirety.

FIELD OF THE DISCLOSURE

The disclosure relates to a gluing unit, in particular for a labeling apparatus, with a glue roller and a motor for driving the glue roller.

BACKGROUND

Such gluing units are known, for example, for labeling machines for labeling bottles in the beverage industry. The glue roller is used to transfer glue onto so-called pallets, which in turn apply the glue onto the back side of the labels to be applied. Using a gripper cylinder, the labels are then removed from the pallets and applied to the respective containers.

In known gluing units, glue rollers are usually plugged onto a polygonal shaft. The shaft has a ball bearing mounting at the lower end in the housing. The upper end of the shaft has a counter-bearing in a hinged lid. For changing the glue roller, the lid is opened and the glue roller is then pulled off upwardly from the shaft.

The glue roller has an end-to-end hub with a polygonal profile. The shaft-hub connection should be designed with possibly no tolerance but well detachable. This is achieved for known glue rollers by the selection of respective materials. The shaft is typically made of stainless steel, while the hub is made of a copper and/or brass alloy. This results in a composite construction that is relatively complex. In addition, the internal centering requires heavy cast elements, so that the mass of known glue rollers is correspondingly large. This is also ergonomically unfavorable because the removal of known glue rollers is usually performed by raising, as described above.

Glue rollers, which can be removed laterally, are also known. This is ergonomically more favorable, since lifting the heavy glue roller can be largely avoided. However, for known systems, it is quite complex to separate the connection between the glue roller and the drive motor.

SUMMARY OF THE DISCLOSURE

One aspect of the present disclosure is therefore to provide a gluing unit that enables simple removal of the glue roller.

For this purpose the disclosure provides a gluing unit, in particular for a labeling apparatus, comprising a glue roller and a motor for driving the glue roller, where the motor is positioned above the glue roller, where the motor is with respect to a support structure of the motor mounted in a height-adjustable manner and where the height of the motor is adjustable using a lever, in particular using an elbow lever or a rocker lever.

Due to the height-adjustable mounting of the motor, it is, for removing the glue roller, possible to first raise the motor and then remove the glue roller laterally. By use of a lever, the force required by an operator to adjust the height position of the motor can be reduced.

The motor can be in particular a direct drive motor, for example, an electric servo motor. Individual control of the rotational speed can thereby be achieved. This is useful, for example, to achieve precise synchronization between the surface speed of the glue roller and the varying roll-off motion speed of a labeling palette during normal operation. This in turn can improve the quality of glue transfer.

The gluing unit can be designed in particular for a labeling apparatus for labeling containers in the beverage industry, in particular for labeling bottles. The glue roller can be designed for transferring hot glue or cold glue.

The motor can from an operating position in a first height position be brought to a removal position in a second height position, where the glue roller can be removed in the removal position from the gluing unit by a lateral motion.

The motor can in the removal position in particular be arranged higher than in the operating position. In other words, the motor can be raisable from the first height position to the second height position.

In the operating position, the glue roller can be fixed in the gluing unit.

The gluing unit can in particular comprise an adjustment apparatus for the motor, which is designed such the height position of the motor is adjustable using the adjustment apparatus.

The motor can in particular be mounted movable along a guide, in particular along a linear guide. This allows a controlled change of position of the motor. The motor can be connected via the guide with the support structure. The guide can in particular be supported by or mounted on the support structure. The guide can comprise at least one strut, two struts in particular.

It is in operating the gluing unit appropriate to arrange the axis of the glue roller, in particular its longitudinal axis, approximately vertically.

The motor can therefore in particular be mounted movable along an essentially vertical axis. The vertical axis can in particular be an axis parallel to the longitudinal axis of the glue roller. The vertical axis can also correspond to the longitudinal axis of the glue roller.

The lever can be designed as a rocker lever. A sprocket can be fixed at the rocker lever and slides in a cam groove. The cam groove can be applied on the motor housing. The sprocket and the cam groove can be arranged in particular such that the motor is adjustable in height by operating the rocker lever. In addition, a spring can be attached, which pushes the motor downwardly. Thereby, firstly the connection to the glue roller can be kept under tension, and secondly, the motor can thus be held in the upper position in that the spring presses the rocker lever in a dead-center position.

The lever, in particular in the form of an elbow lever or a rocker lever, can in particular be part of the above-mentioned adjustment apparatus.

The gluing unit can further comprise a glue wiper. The glue can therewith be accurately applied in a previously determined manner onto the surface of the glue roller.

The glue wiper can in particular comprise a first locking element, and the labeling apparatus can further comprise a support for the glue wiper comprising a second locking element, and the locking elements can be locked with each other by rotation of one or both locking elements. This also allows for quick and easy replacement of the glue wiper.

Locking is presently to be understood, in particular, in that the two locking elements are connectable to each other in a positive-fit manner. A screwed connection, for example, can not be regarded as being a locking connection.

The locking elements can be lockable to each other in particular by rotation of one or both locking elements about the respective longitudinal axis of the locking elements. In other words, either the first locking element or the second locking element or the first locking element and the second locking element can respectively be rotated about their longitudinal axes to establish a lock of the two elements with each other.

The first or the second locking element can be in particular a socket, a tube, a part of a pipe, or a part of a shaft, or a part of an axle.

In particular, the second locking element can be part of a cylindrical rotary axle. In other words, the support or mounting for the glue wiper can be a rotary axle, in particular a substantially cylindrical rotary axle.

One of the locking elements can have a recess, where the recess and the other locking element are configured such that the other locking element in a first orientation can be introduced into the recess and, following a rotation, in a second orientation is connected with the one locking element in a positive-fit manner.

The recess can, for example, be a cylindrical receiving bore, which is exposed or slotted in one area. In this case, the other locking element can be formed such that it can in the slotted portion in a first orientation be introduced into the cylindrical receiving bore, where it is designed such that it can after rotation no longer be removed from the receiving bore through the exposed or slotted portion, it is therefore connected in a positive-fit manner with the locking element having the receiving bore.

For releasing the connection or the lock, one or both of the locking elements can be respectively rotated back so that the positive fit can be cancelled. For example, one locking element can again be rotated into the first orientation, so that it can be removed from the recess.

According to one example, one of the locking elements can have a circular cross-section with two oppositely disposed flattened portions, and the other of the locking elements has a U-shaped seat with a widening, where the one of the locking elements, due to the flattened portion, fits in the U-shaped seat and can be locked with the other of the locking elements by rotation in the area of the widening. As a result, particularly simple locking can be enabled. The locking element with the oppositely disposed flattened portions can in particular be the second locking element. The locking element with the U-shaped seat can in particular be the first locking element.

The locking element with two oppositely disposed flattened portions can in particular have the flattened portions only in a first segment, whereas the cross-section in a second segment is completely circular. In this case, the gluing unit can be formed such that the locking elements are lockable by rotation of one or both locking elements and moving of one or both locking elements along the longitudinal axis of one or both locking elements, so that after movement along the longitudinal axis, the seat of the one locking element is disposed in the segment of the other locking element having a completely circular cross-section. With such a construction, unwanted release of the lock can be efficiently prevented. To release the lock, movement along a longitudinal axis and a respective rotation can again be performed.

The first and the second locking element can be configured such that a rotation of one or both of the locking elements in a specific angular range is possible without releasing the connection or the lock. This enables slight rotation of the glue wiper which is necessary for adjusting the thickness of the glue film.

The glue roller can have a cylindrical jacket, on each upper and lower opening of which a lid plate is arranged, and where one of the lid plates comprises a gearing, in particular a Hirth-type serration, for connecting the glue roller with a drive motor. A torque-transmitting rotary coupling can via the gearing be established with the motor, in particular a Hirth-type coupling. This has the advantage that this coupling even under limited space conditions is easily engaged and disengaged merely by a pivoting motion.

The gearing can have the same teeth and teeth gaps, respectively, uniformly distributed in the circumferential direction. In this case, an additional positioning device can be provided for a predetermined position of engagement between the gearing of the glue roller and of the gearing of the drive motor. This can be, for example, a centering pin or a seat for a centering pin. The respective complementary centering element can be provided at the gearing of the drive motor.

Alternatively the gearing can also have an irregular arrangement of the teeth. In this case, the irregular arrangement of the teeth can serve positioning, since a positive-fit connection to an irregular arrangement of teeth in a gearing of the rotation motor is only possible at an angular position.

For connecting the glue roller with a support device or a mounting device, one of the lid plates can comprise a receiving cone as a counterpart to a centering tip of the support device. This can in particular be the other lid plate, i.e. the one that is opposite to the lid plates with the gearing.

The receiving cone can also be referred to as a centering indentation. A connection to a centering tip allows for particularly reliable and low-wear centering.

Alternatively, a centering tip disposed on the lid plate, in particular, connected to the latter can be provided for connecting the glue roller with a support device.

The gluing unit can comprise in particular a magnetic axial lock to stabilize the position of the gluing unit in an installed position. The magnetic axial lock can in particular comprise a magnet being disposed in particular in the Hirth-like serration. For example, one or more tooth elements can be formed by a magnet, in particular, a permanent magnet.

Alternatively or additionally, one or more magnets can also be disposed in the gear ring of the motor.

It is also conceivable to use a force- and/or positive-fit axial lock, for example, in the form of a clamping screw or a bayonet coupling.

The rotor of the motor can be thermally insulated from the rotor shaft. This can prevent the heat from the motor to be transmitted to the glue roller. Increased temperature would have the glue film become touch dry.

The thermal insulation can be achieved, for example, by fiber-reinforced thermosetting material. Also thermoplastics, in particular with fiber reinforcement are conceivable.

The cylindrical jacket can have a thickness of 1 mm to 5 mm, in particular from 1.5 mm to 3 mm. This makes a particularly lightweight embodiment of the glue roller possible.

The cylindrical jacket can in particular comprise stainless steel or be made from stainless steel.

The cylindrical jacket can also comprise carbon-fiber-reinforced plastic (CFRP) or be made therefrom. Further weight reduction is thereby possible.

At least one ring-shaped element made of a metal, in particular steel, can be incorporated into the carbon-fiber-reinforced plastic, where the at least one ring-shaped element is disposed in particular in the region of the upper or lower edge of the cylindrical jacket. With such a ring-shaped element, a sharp ridge can be provided at the edges of the cylindrical surface, which enables accurately wiping off the glue.

The cylindrical jacket can be coated with, in particular, a metallic wear-resistant coating, in particular on its outer side.

At least the outer side of the cylindrical jacket can be, for example, hard-chromed. The hard chromium layer can serve as a wear-resistant coating for the glue roller's contact with a glue wiper when wiping off glue. The cylindrical jacket can also be entirely hard-chromed. Also the lid plates can be partially or entirely hard-chromed.

The hard chromium layer can have a thickness of 30 microns to 60 microns, advantageously from 60 microns to 150 microns.

As an alternative to hard chroming, other coatings and/or hardenings are conceivable. For example, at least the outer side of the cylindrical jacket can be provided with a gel coat layer or a chromium-oxide coating. At least the outer side of the cylindrical jacket can alternatively or additionally also be plasma nitrided.

At least part of the outer side of the cylindrical jacket can be formed such that the surface in this part has a depth of roughness (average depth of roughness Ra) of less than 2 microns, in particular less than 1 micron. A depth of roughness of Ra=0.03 microns to 0.06 microns has been found to be advantageous. In particular, an above-described wear-resistant coating can have said depth of roughness.

The part of the outer side of the cylindrical jacket having said depth of roughness can, in particular, be the part which during operation comes into contact with the glue wiper. With such a smooth surface, uniform application of glue can be achieved. Moreover, such a surface can be easily cleaned. The entire outer side of the cylindrical jacket can also comprise such a depth of roughness.

At least part of the outer side of the cylindrical jacket can be formed such that the surface in this part has a surface hardness of 53 HRC (Rockwell C) to 62 HRC. This can be in particular achieved by a wear-resistant coating described above. A hardness of 68 HRC to 72 HRC has proven advantageous (corresponding to 900 HV (Vickers hardness) to 1200 HV).

The part of the outer side of the cylindrical jacket having said hardness can, in particular, again be the part which during operation comes into contact with the glue wiper. Advantageous abrasion resistance or wear resistance, respectively, can thereby be achieved. Corrosion resistance can also be improved. The entire outer side of the cylindrical jacket can also comprise such a surface hardness.

The lid plates can be welded to the cylindrical jacket, in particular, be laser welded.

The interior of the glue roller can be hollow. In other words, the space region inside the cylindrical jacket and between the two lid plates can be free of other elements. This can result in further reduction of weight.

The two lid plates can have a low thickness or material thickness, in particular between 3 mm and 6 mm.

On the inner side of the cylindrical jacket, one or more stiffening elements can be arranged, in particular stiffening rings. The stiffening elements can in particular be welded to the inner side of the jacket. With the stiffening elements, higher stability can be achieved when the cylindrical jacket is thin-walled.

Alternatively or additionally, foam can be disposed at least in a portion of the interior of the glue roller. The foam can in particular fill the entire cavity in the interior of the glue roller. This foam likewise enables stabilization of the jacket.

The foam can for example correspond to foamed plastic, in particular polyurethane foam.

The disclosure furthermore provides a gluing unit, in particular for a labeling apparatus, comprising a glue roller and a motor for driving the glue roller, where the motor is positioned above the glue roller, where the glue roller is via a mounting connected to a support structure, and where the gluing unit is embodied such that the height of the mounting of the support structure is adjustable.

In this gluing unit, in particular the mounting can be lowered which again enables simple lateral removal of the glue roller.

The mounting can in particular bear the end of the glue roller that is not designed for connection to the motor, in particular the lower end of the glue roller during operation.

The mounting can comprise a receiving cone or a centering tip.

The mounting can be mounted movable, in particular vertically, along a guide, in particular, along a linear guide.

The height of the mounting can be adjustable using a lever, in particular using an elbow lever or a rocker lever.

The mounting can therefore from an operating position in a first height position be brought to a removal position in a second height position, where the glue roller can in the removal position with a lateral motion be removed from the gluing unit.

The mounting can in the operating position, in particular, be arranged higher than in the removal position. In other words, the mounting can be lowerable from the first height position to the second height position.

The gluing unit and/or its elements can also comprise one or more of the above features.

The invention also provides a labeling apparatus with one of the above-described gluing units. The gluing unit can comprise one or more of the above-mentioned features.

The labeling apparatus can in particular be a labeling apparatus for labeling containers in the beverage industry, in particular for labeling bottles.

The labeling apparatus can also comprise a palette carousel with a plurality of palette shafts, a label magazine, and an upper gripper cylinder. With these elements, the labels can first be applied glue and then be positioned by the gripper cylinder onto containers, for example bottles. The individual elements of the labeling apparatus can be arranged on a common support structure. In this case, the motor is likewise mounted on this support structure. It is also possible, however, to mount the main components, in particular the motor, on their own support structures.

BRIEF DESCRIPTION OF THE DRAWINGS

Further features and advantages of the disclosure shall be explained below with reference to the figures by way of example.

DETAILED DESCRIPTION

Figure 1:
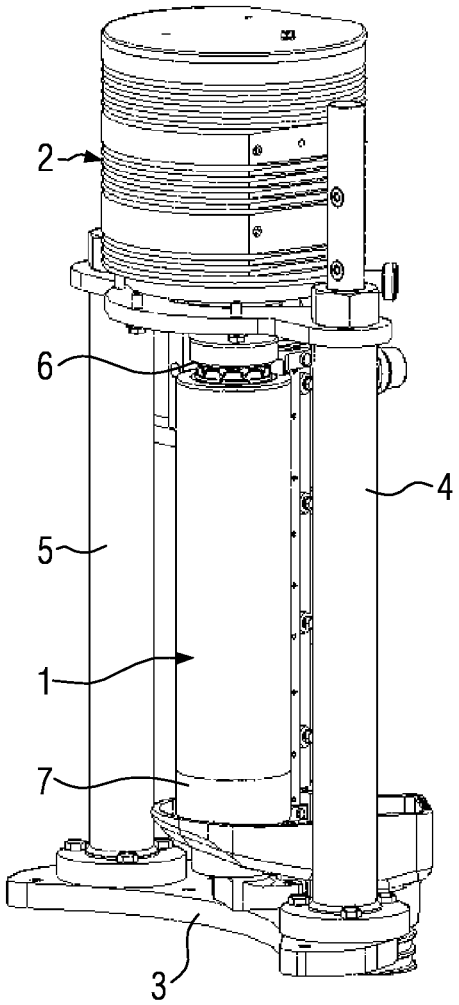
FIG. 1 shows an example of a gluing unit for a labeling apparatus.

FIG. 1 shows parts of an example of a gluing unit. The gluing unit can be part of a labeling apparatus, in particular for liquid containers such as bottles. For reasons of clarity, known elements such as a label magazine, a pallet carousel and gripper cylinders are not shown.

The gluing unit shown comprises a glue roller 1 with a motor 2 for driving the glue roller 1. The motor is during operation disposed above the glue roller 1. This has the advantage that water runs off downwardly during cleaning and thereby poses less risk that water passes through a potentially vulnerable rotary seal into the motor 2. The motor 2 is via two columns or tie bars 4, 5 height-adjustably mounted to a support structure 3, in particular a steel plate. In other words, mounting of the motor 2 is embodied such that the height of the motor 2 above the support structure 3 can be varied.

In the upper region 6 of the glue roller 1, the glue roller 1 is via a rotary coupling, in particular a Hirth-like coupling, connected to the motor 2. In the lower region 7 of the glue roller 1, the glue roller 1 is connected to a support or mounting for the glue roller 1. In particular, the glue roller 1 can there be mounted using a centering tip and a corresponding centering cone for receiving the centering pin. Particularly stable mounting is thus possible. The bottom side of the glue roller 1 can therefore comprise either a centering tip or a centering cone.

Figure 2:
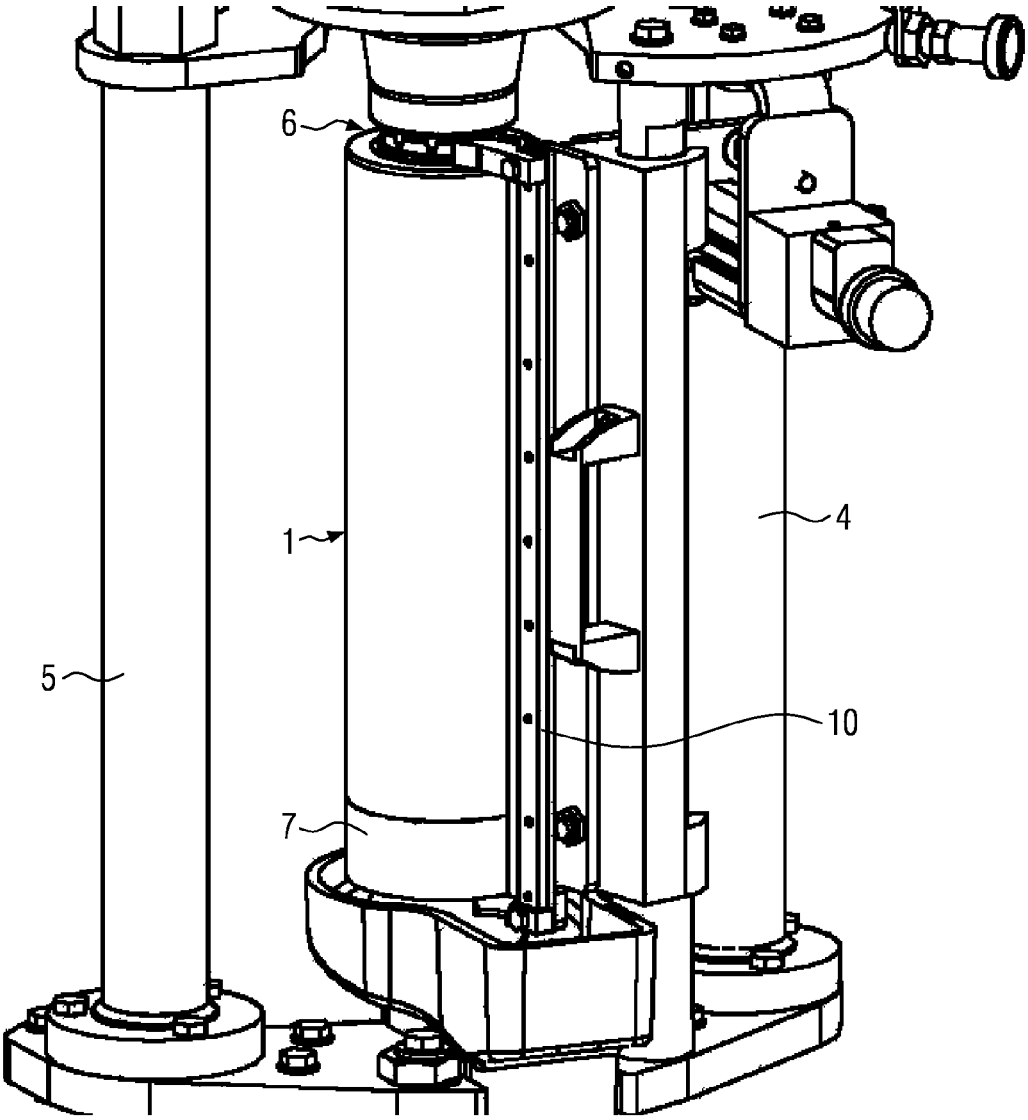
FIG. 2 shows a detailed view of a glue roller of an exemplary gluing unit.

FIG. 2 shows another detailed view of an example of the gluing unit. In addition to the columns 4, 5 of the glue roller 1 with the upper region 6 and the lower region 7, this figure also shows a glue wiper 10, which also comprises a scraper to remove excess glue from the glue roller 1.

FIG. 3 shows details for mounting the motor 2 above the glue roller 1, in particular an adjustment mechanism for changing the height of the motor 2 above the support structure 3.

Figure 3A:
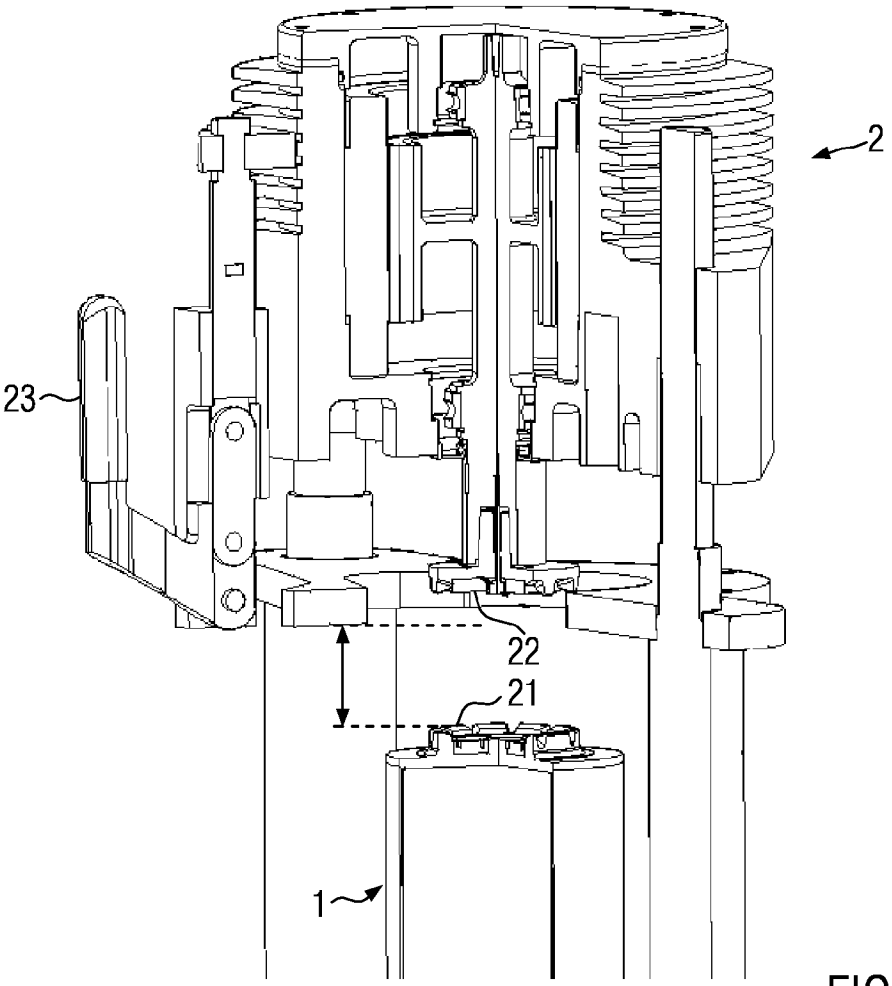
FIGS. 3A and 3B show details for height-adjustable mounting of a motor of an exemplary gluing unit.

The adjustment apparatus comprises an elbow lever 23. In the position of the elbow lever shown in FIG. 3A, the motor 2 is disposed in a height position in which the connection between the glue roller 1 and the motor 2 is separated A spacing is therefore formed between the gearing elements 21 of the glue roller 1 and the counter gearing ring 22 of the motor 2, which makes it possible that the glue roller 1 is removed laterally by a pivoting motion. The spacing between the glue roller 1 and the motor 2 is illustrated in FIG. 3A by a double-headed arrow.

The motor 2 can be moved along guide rods (i.e., a linear guide) substantially along a vertical axis.

Figure 3B:
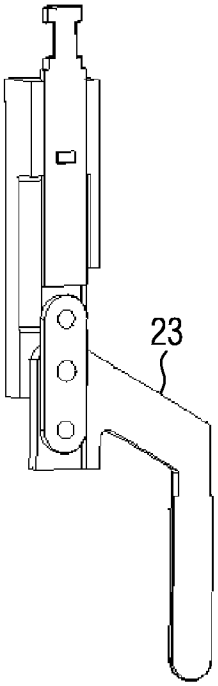

When the elbow lever 23, as shown in FIG. 3B, is brought into a second position, also the height position of the motor 2 can change such that the gearings 22 and 21 engage with each other, i.e. that a driving connection is established between the motor 2 and the glue roller 1.

The gluing unit can also comprise a magnetic axial lock to stabilize the position of the glue roller in an installed position. In this case, the glue roller, in contrast to FIG. 3A, can be raised also by magnetic force together with the motor. For removing the glue roller laterally, the magnetic axial lock can be releasable with a pivot motion of the upper end of the glue roller.

In the case of force- and/or positive-fit axial lock, it can be necessary to bring the force- and/or positive-fit axial locking in a release position prior to the lateral removal of the glue roller.

Figure 4:
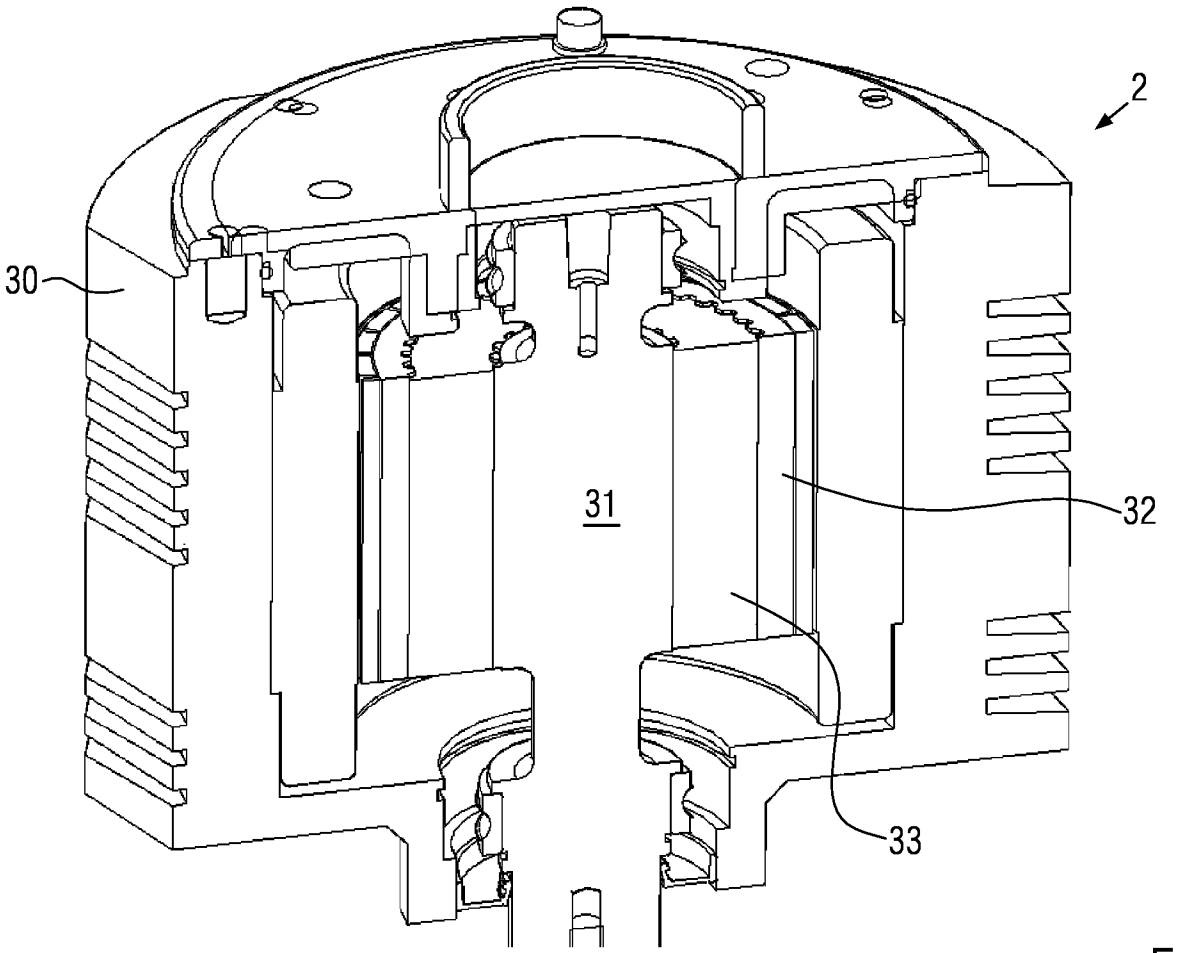
FIG. 4 shows a cross-section through a motor of an exemplary gluing unit.

FIG. 4 shows a cross-section through an example of the motor 2. The rotor shaft 31 is separated by thermal insulation 33 from the rotor 32. This can prevent that heat from the motor 2 is transmitted to the glue roller and thereby dries the glue film to the glue roller. The motor 2 further comprises an outer housing 30 protecting the movable parts of the motor 2.

Figure 5:
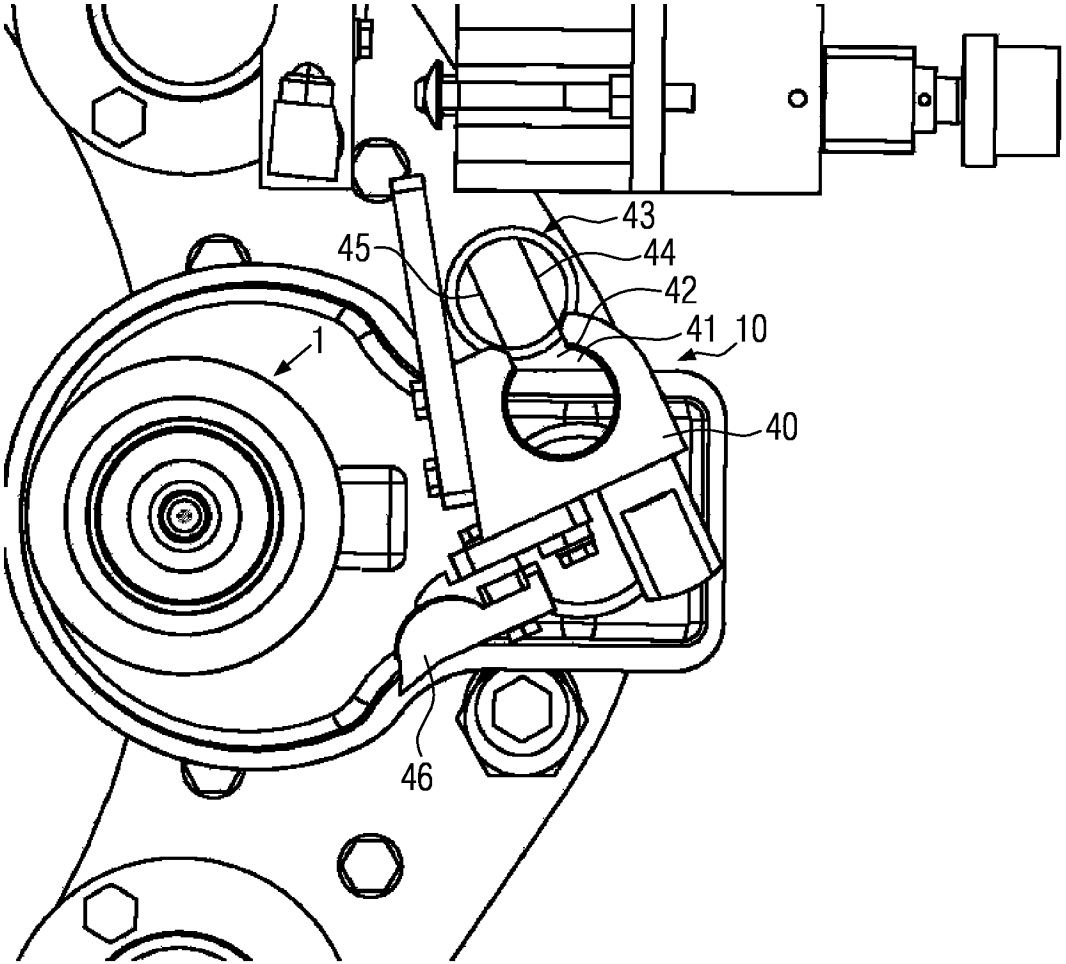
FIG. 5 shows a plan view of a locking mechanism for a glue wiper of an exemplary gluing unit in a first position.

FIG. 5 illustrates an example of a locking mechanism for a glue wiper 10. For this, the glue wiper 10 comprises a first locking element 40 comprising a U-shaped seat with a widening 41. This widening 41 is embodied as a cylindrical receiving bore. Due to a recess 42 in the locking element 40, the widening 41 is accessible from the outside.

A support or mounting 10 for the glue wiper, which is connected, for example, to the support structure, comprises a second locking element 43 having a circular cross-section, which is provided with two oppositely disposed flattened portions 44 and 45. The spacing between the flattened portions 44 and 45 corresponds to the extension of the recess 42 in the first locking element 40.

Due to the flattened portion 44, 45, the locking element 43 therefore fits into the U-shaped seat, in particular in the recess 42, if the locking element 43 is arranged in the correct orientation in which the flattened portions 44, 45 are in alignment with the edges the recess 42.

FIG. 5 also shows the upper portion 46 of the glue wiper 10 and the glue roller 1.

Figure 6:
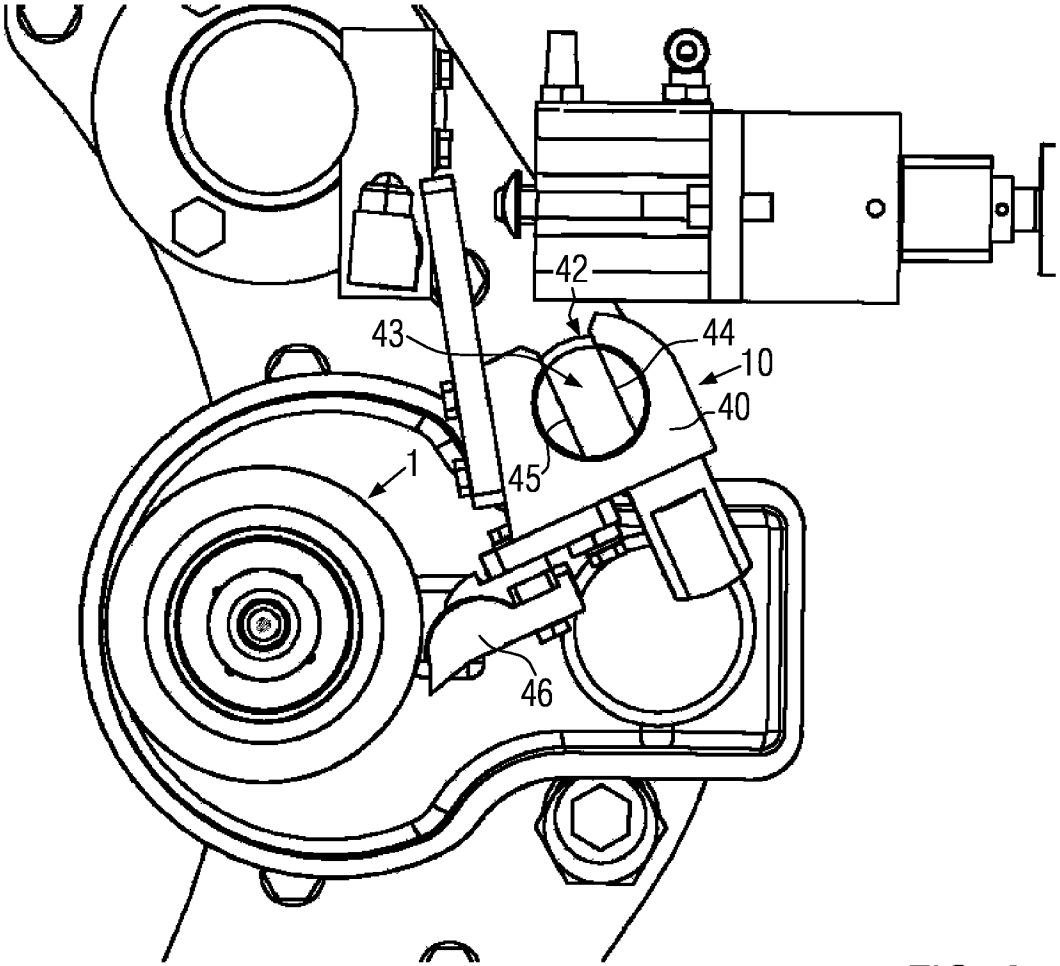
FIG. 6 shows a locking mechanism according to FIG. 5 in a second position.

FIG. 6 shows the locking system of FIG. 5, as described above, but where the second locking element 43 has been inserted through the recess 42 into the widening in the form of a cylindrical receiving bore. In this orientation, however, there is still no complete positive fit between the locking elements 40 and 43. The locking element 43 could in fact again be disengaged by the seat 42.

Figure 7:
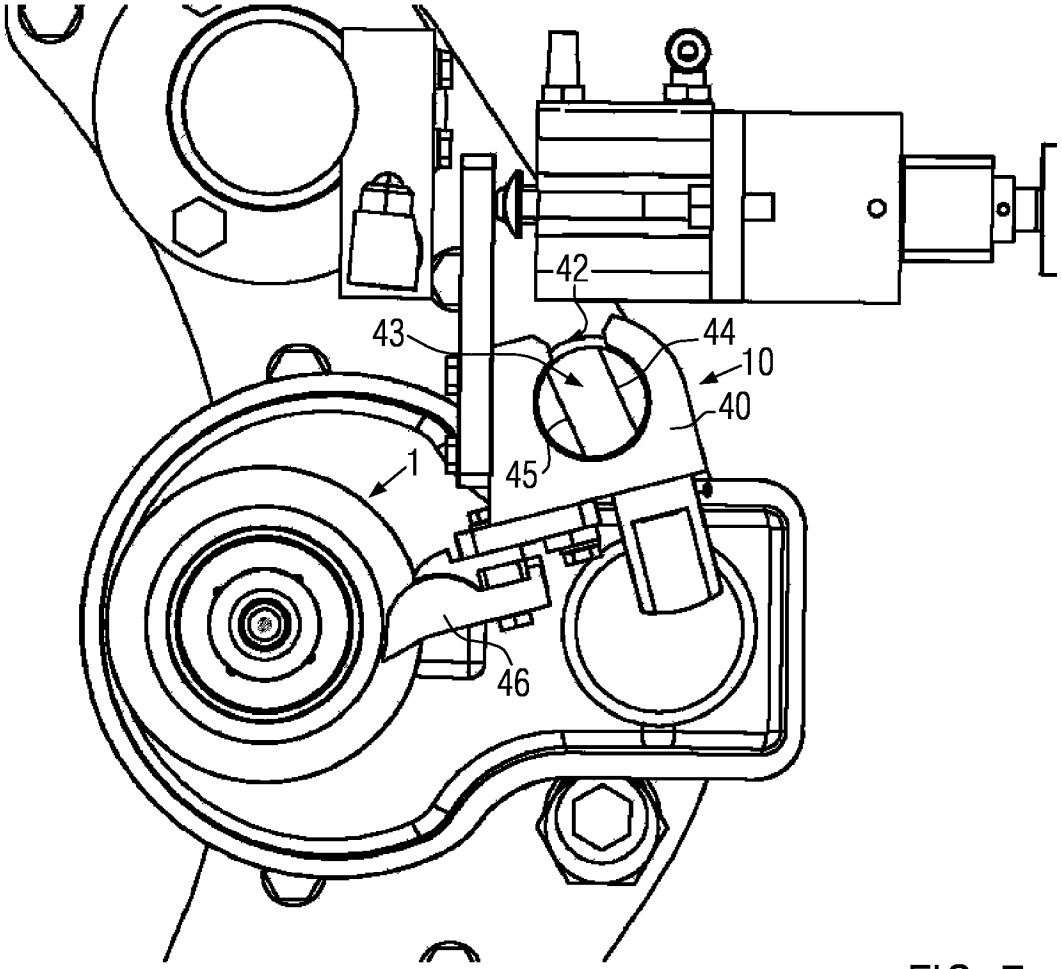
FIG. 7 shows a locking mechanism according to FIGS. 5 and 6 in a third position.

FIG. 7 shows the locking system described in FIGS. 5 and 6, where the locking elements 40, 43 have been locked with each other by rotation of the first locking element 40 about its longitudinal axis. In other words, a positive-fit connection between the locking elements 40, 43 is established by the rotation.

Figure 8:
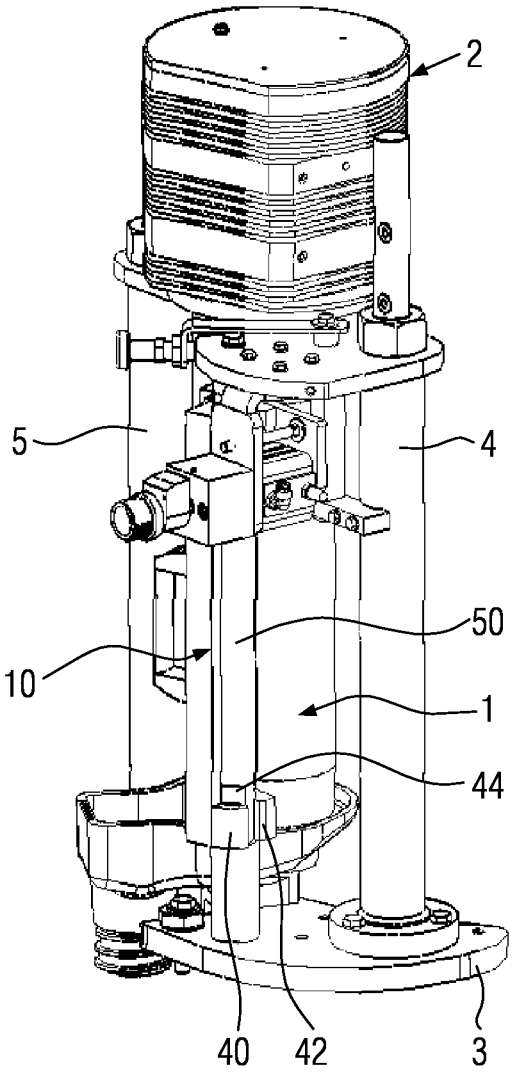
FIG. 8 shows a perspective view of an exemplary gluing unit.

FIG. 8 shows a perspective view of the gluing unit, where the glue wiper 10 is via an above-described locking mechanism connected with a seat or mounting axle 50. The first locking element 40 with the recess 42 is shown. Furthermore, one of the flattened portions 44 of the second locking element can be seen. After rotation, a translation of the glue wiper 10 is performed in a direction parallel to the longitudinal axis of the mounting axle 50. Thereby, the first locking element 40 has been moved to a region of the axle 50, in which the cross-section of the axle 50 is completely circular. This allows a secure connection to be made, because unlocking first requires slight raising of the glue wiper 10 and a subsequent rotation.

Figure 9:
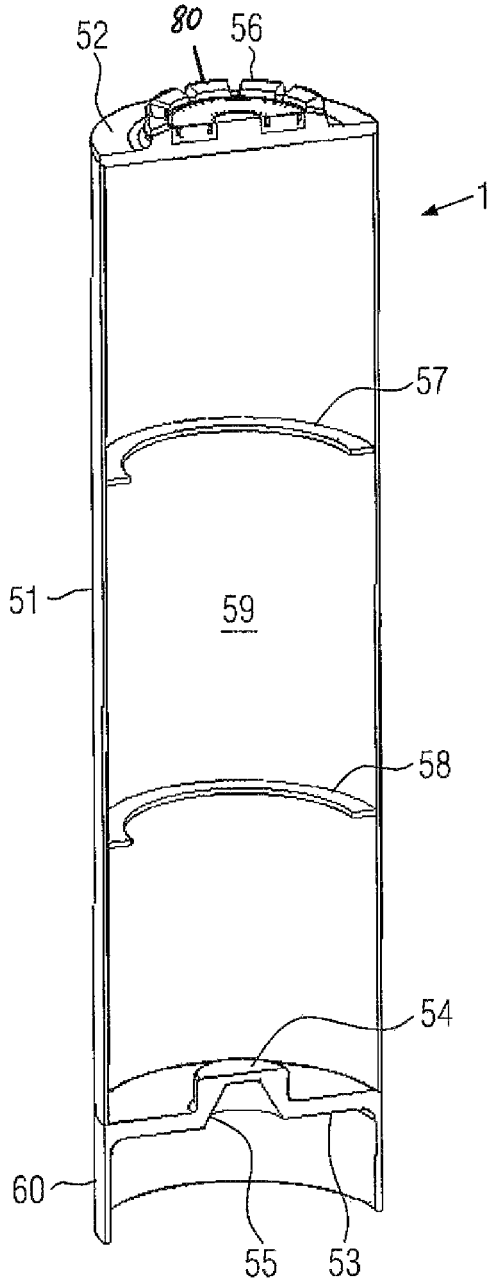
FIG. 9 shows a cross-section through an exemplary glue roller.

FIG. 9 shows a cross-section through an example of a glue roller 1. The glue roller can be manufactured, as shown, in particular in a light-weight design. The glue roller 1 comprises a cylindrical jacket 51, which can comprise, for example, steel and/or carbon-fiber-reinforced plastic (CFRP—Carbon-Fiber-Reinforced Plastic). The jacket 51 can be formed in a thin-walled manner, in particular with a thickness or material thickness of 1 mm to 5 mm, in particular from 1.5 mm to 3 mm. Stiffening rings 57, 58 can be disposed in the interior 59 of the glue roller 1 to reinforce the thin-walled jacket 51. Apart from the stiffening rings 57, 58, the interior 59 of the glue roller 1 can be hollow. However, the interior space 59 can also be filled with foamed-up material. Due to this foam, additional stabilization of the glue roller can be achieved, yet keeping the weight low.

Lid plates 52, 53 are arranged at the upper and lower ends of the cylindrical jacket 51. Gearing elements 56 are arranged on the upper lid plate 52, in particular a Hirth-type serration, in order to be able to establish a connection with a drive motor. A permanent magnet 80 is arranged in the region of the gearing elements 56 and can serve as an axial lock for the glue roller 1.

In the lower lid plate 53, a receiving cone 54 is provided whose surface 55 serves as a counter-support for a centering tip of a support device. At the lower lid plate 53, a wall extension 60 is further connected protecting the connection region between the glue roller and the support device from glue. The wall extension 60 can be integrally formed with the lower lid plate 53 or be connected thereto, in particular in a material-fit manner.

Figure 10:
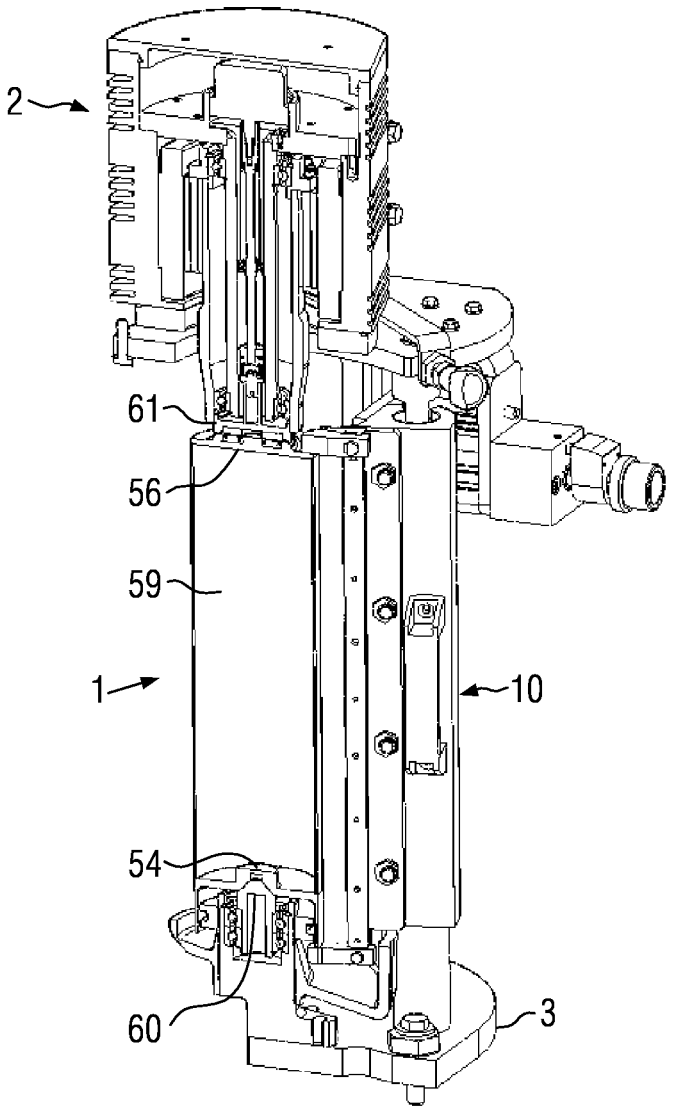
FIG. 10 shows a cross section through an exemplary glue roller in an installed position.

FIG. 10 shows the example of a glue roller 1 from FIG. 9 in an installed position. The centering tip 60 of the support device is there also visible. The glue roller 1 is via this centering tip 60 mounted on a support structure 3.

Also visible is the gear ring 61 of the motor 2 which is in connection with the gearing elements 56 of the glue roller 1, so that the torque can be transferred from the motor to the glue roller 1.

The motor 2 can be, in particular, a servo motor or a stepper motor.

Figure 11A:
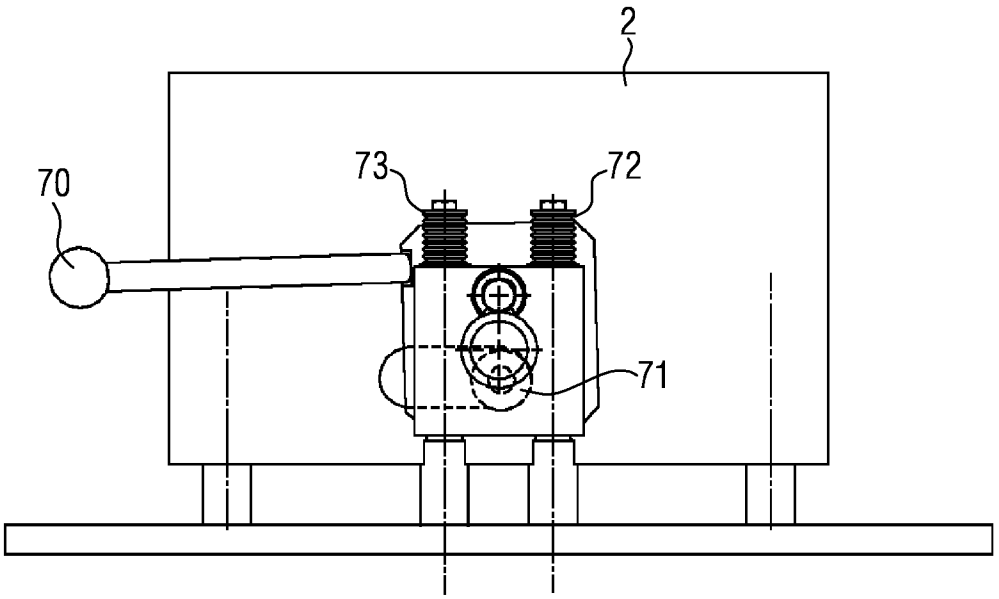
FIGS. 11A to 11C show details for a height-adjustable mounting of a motor of a further exemplary gluing unit.
Figure 11B:
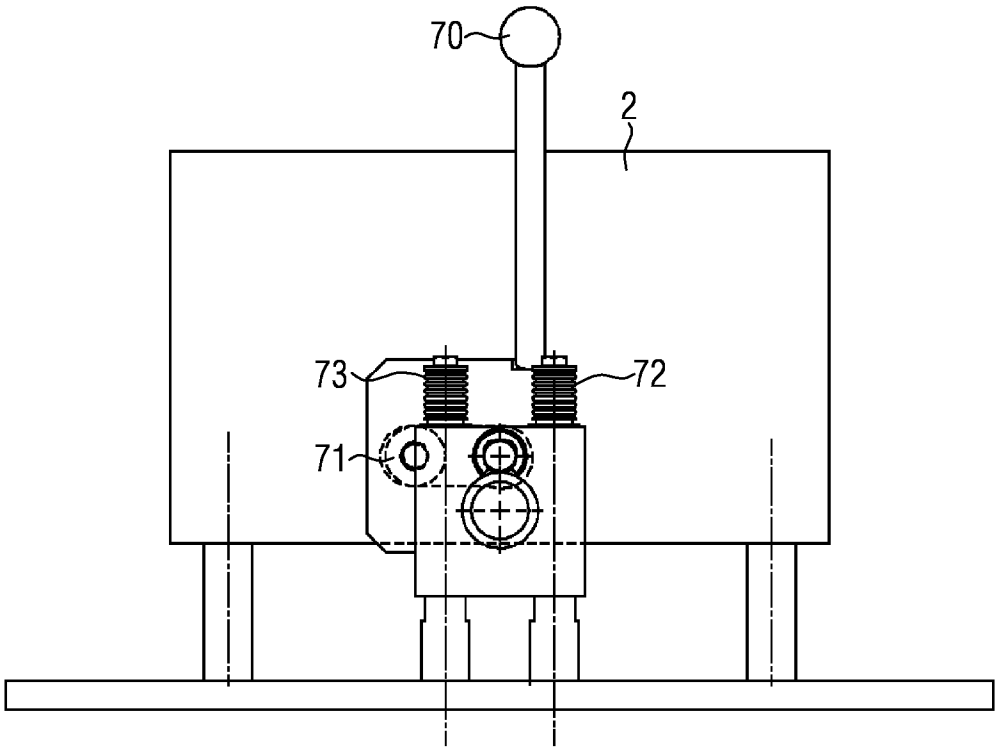
Figure 11C:
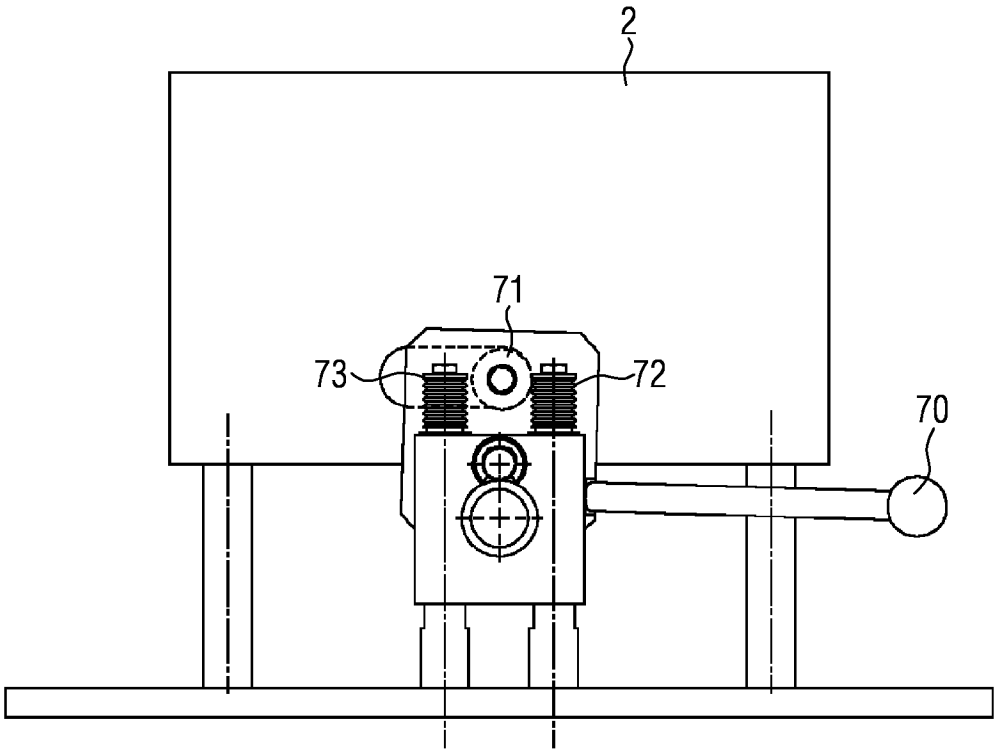

FIGS. 11A to 11C show a portion of an example of a gluing unit, in which the height of the motor 2 is adjustable using a rocker lever 70. A sprocket 71 sliding in a cam groove is fixed at the rocker lever 70. The cam groove can be applied on the motor housing. The sprocket 71 and the cam groove are arranged such that the motor is adjustable in height by moving the rocker lever. In addition, spring elements 72, 73 are attached, pushing the motor 2 downwardly. Thereby, firstly the connection to the glue roller can be kept under tension; and secondly, the motor 2 can thus be held in the upper position in that the spring elements 72, 73 press the rocker lever 70 in a dead-center position.

It is understood that the features mentioned in the embodiment described above are not restricted to these specific combinations and are also possible in any other combination.

The invention claimed is:

1. A gluing unit, comprising a glue roller and a motor for driving said glue roller, said motor being positioned above said glue roller, said motor being, with respect to a support structure of said motor, mounted in a height-adjustable manner, and the height of said motor being adjustable using a lever;

wherein said motor can, from an operating position in a first height position, be brought to a removal position in a second height position, and wherein said glue roller can, in the removal position, be removed from the gluing unit by a lateral motion.

2. The gluing unit according to claim 1, wherein said motor is mounted movable along a guide.

3. The gluing unit of claim 2, wherein the guide is a linear guide.

4. The gluing unit according to claim 1, wherein said motor is mounted movable along an essentially vertical axis.

5. The gluing unit according to claim 1, and a glue wiper comprising a first locking element, and a support for said glue wiper comprising a second locking element, wherein said locking elements can be locked with each other by rotation of one or both locking elements.

6. The gluing unit according to claim 5, wherein said first or said second locking element can be one of a socket, a part of a pipe, a part of a shaft, and a part of an axle.

7. The gluing unit according to claim 5, wherein said first locking element comprises a recess, and wherein said recess and said second locking element are configured such that said second locking element in a first orientation can be introduced into said recess and, following a rotation, in a second orientation is connected with said first locking element in a positive-fit manner.

8. The gluing unit according to claim 5, wherein said second locking element has a circular cross-section with two oppositely disposed flattened portions, and the said first locking element has a U-shaped seat with a widening section, wherein said second locking element, due to the flattened portions fits into said U-shaped seat and can be locked with said first locking elements by rotation in the area of the widening section.

9. The gluing unit according to claim 1, wherein said glue roller comprises a cylindrical jacket, on each upper and lower opening of which a lid plate is arranged, and wherein one of said lid plates comprises a gearing, for connecting said glue roller with a drive motor.

10. The gluing unit of claim 9, wherein the gearing is a Hirth-type serration.

11. The gluing unit according to claim 1, wherein said glue roller comprises a cylindrical jacket, on each upper and lower opening of which a lid plate is arranged, and where one of said lid plates comprises one or more elements for connecting said glue roller with a support device of a labeling apparatus.

12. The gluing unit according to claim 11, wherein said lid plate for connecting said glue roller to a support device comprises one of a centering tip and a receiving cone as a counterpart to a centering tip of said support device.

13. The gluing unit according claim 12, wherein said cylindrical jacket has a thickness from 1 mm to 5 mm.

14. The gluing unit of claim 13, wherein the thickness is from 1.5 mm to 3 mm.

15. The gluing unit according to claim 1, comprising a magnetic axial lock for stabilizing the position of said glue roller in an installed position.

16. The gluing unit according to claim 1 wherein a rotor of said motor is thermally insulated from the rotor shaft.

17. The gluing unit of claim 1, wherein the gluing unit is for a labeling apparatus.

18. The gluing unit of claim 1, wherein the lever is one of an elbow lever and a rocker lever.

19. A gluing unit, comprising a glue roller and a motor for driving said glue roller, said motor being positioned above said glue roller, said glue roller being connected to a support structure via a mounting, and said gluing unit being embodied such that the height of said mounting of said support structure is adjustable, wherein said motor can, from an operating position in a first height position, be brought to a removal position in a second height position, and wherein said glue roller can, in the removal position, be removed from the gluing unit by a lateral motion.

20. The gluing unit of claim 19, wherein the gluing unit is for a labeling apparatus.

* * * * *